US008081783B2

(12) United States Patent
Chien et al.

(10) Patent No.: US 8,081,783 B2
(45) Date of Patent: Dec. 20, 2011

(54) MINIATURE ACOUSTIC TRANSDUCER

(75) Inventors: Hsin-Tang Chien, Yilan County (TW); Peter Chang, Hsinchu (TW); Nai-Hao Kuo, Kaohsiung County (TW)

(73) Assignee: Industrial Technology Research Institute, Hsinchu (TW)

( * ) Notice: Subject to any disclaimer, the term of this patent is extended or adjusted under 35 U.S.C. 154(b) by 1195 days.

(21) Appl. No.: 11/762,081

(22) Filed: Jun. 13, 2007

(65) Prior Publication Data

US 2007/0291964 A1 Dec. 20, 2007

Related U.S. Application Data

(60) Provisional application No. 60/815,374, filed on Jun. 20, 2006.

(30) Foreign Application Priority Data

Dec. 29, 2006 (TW) ..... 95149965 A

(51) Int. Cl.
*H04R 25/00* (2006.01)

(52) U.S. Cl. ..... 381/174; 381/175

(58) Field of Classification Search ..... 381/113, 381/116, 174, 175, 191, 355; 29/594, 609.1; 367/140, 170, 181
See application file for complete search history.

(56) References Cited

U.S. PATENT DOCUMENTS

| | | | | |
|---|---|---|---|---|
| 5,146,435 | A | 9/1992 | Bernstein | |
| 5,452,268 | A | 9/1995 | Bernstein | |
| 5,490,220 | A | 2/1996 | Loeppert | |
| 5,578,843 | A | 11/1996 | Garabedian et al. | |
| 5,633,552 | A | 5/1997 | Lee et al. | |
| 5,659,195 | A | 8/1997 | Kaiser et al. | |
| 5,668,303 | A | 9/1997 | Giesler et al. | |
| 5,870,482 | A | 2/1999 | Loeppert et al. | |
| 6,075,867 | A | 6/2000 | Bay et al. | |
| 6,479,878 | B1 | 11/2002 | Okawa et al. | |
| 6,493,288 | B2 | 12/2002 | Khuri-Yakub et al. | |
| 6,535,460 | B2 | 3/2003 | Loeppert et al. | |
| 7,301,213 | B2 * | 11/2007 | Matsubara et al. | 381/175 |

FOREIGN PATENT DOCUMENTS

| | | |
|---|---|---|
| TW | 200621065 | 6/2006 |

OTHER PUBLICATIONS

"Office Action of Taiwan counterpart application", issued on Jan. 12, 2010, p. 1-p. 3.

* cited by examiner

*Primary Examiner* — Brian Ensey
(74) *Attorney, Agent, or Firm* — Jianq Chyun IP Office

(57) ABSTRACT

A technique using a new diaphragm structure and support design is provided herein for microphones or structure designs for pressure sensing. The structure includes a set of capacitive structures. The capacitive structure has a combination of a diaphragm structure, a back plate structure and a surrounding micro-structure for fixing the diaphragm. After the diaphragm structure has deformed due to a pressure load, a gap between the back plate and the diaphragm is changed accordingly, and variation occurs in the capacitance value between the two parallel plates. By using the principle of the effect of capacitance value variation, the capacitive sensor causes the capacitance value to vary with the change in the sound, thus accomplishing the object of measuring.

15 Claims, 10 Drawing Sheets

FIG. 1 (RIOR ART)

MINIATURE ACOUSTIC TRANSDUCER

CROSS-REFERENCE TO RELATED APPLICATION

The present invention claims the benefit of U.S. provisional patent application, Ser. No. 60/815,374, filed on Jun. 20, 2006. This application also claims the priority of Taiwan application serial no. 95149965, filed Dec. 29, 2006. All disclosure of the U.S. and Taiwan application is incorporated herein by reference.

BACKGROUND OF THE INVENTION

1. Field of the Invention

The present invention relates to a miniature acoustic transducer. More particularly, the present invention relates to a miniature acoustic transducer having a structure with a low spring constant.

2. Description of Related Art

The acoustic transducer, produced by a capacitive microphone chip integrated through silicon micro-manufacturing technique and integrated circuit (IC) processing technique, has the advantages of a light mass, a small volume and a good signal quality etc. In applications of national home appliances products, as the demand for handsets has expanded increasingly and the requirements for sound quality have enhanced increasingly, and the markets and techniques for hearing aids have started to flourish as well, capacitive microphone chip has gradually become a mainstream of microphone chips. From the perspective of the market, it is anticipated that the North American market of microphone chips will reach the level of 500 millions in the year of 2004, and will grow stably by 20% annually towards the market from 2004 to 2009, according to the sections about mobile handsets in the market trend reports by Digitimes Corp. Application of microphones on handsets becomes the mainstream of the present market.

Because integrated circuit processes using silicon as the base material are cheap and frequently employed in electronic products, and their application field continues to expand outward, more applications will be fabricated through processes using silicon as the base material combined with the CMOS process to directly integrate reader circuits onto a chip in the future. Additionally, since Taiwan has become the globally largest contract manufacturer for semiconductors, with a contract manufacture share of about 60-70% in the current market, mass production and acceleration of its commercialization process are expected in the future. Therefore, in order to keep away and differentiate in terms of the microphone layout from element designs by various primary factories, it is necessary to acquire novel designs and seize the first chance in manufacturing in the first place, so as to obtain the superiority in the microphone element market and the capability to share the occupancy.

Presently, the application of microphone element structures in mass production is limited to a few types of structures, because manufactories producing micro electro-mechanical systems (MEMS) microphones are currently only a few manufactories, such as Knowles Corp., Infineon Corp. or Sonion Corp., and most of the package processes on the market are still based on the designs developed by Knowles.

Referring to FIGS. 1 to 3, a microphone structure design by Knowles Corp. is shown. An acoustic transducer 10 includes a conductive diaphragm 12 and a perforated member 40, which are supported by a base 30 and separated by an air gap 20. An air gap 22, extremely thin, is present between the conductive diaphragm 12 and the base 30, to enable the diaphragm 12 to move up and down freely and decouple the diaphragm 12 from the base 30. A number of indentations 13 are formed beneath the diaphragm 12, for obviating adsorption phenomena between the diaphragm 12 and the base 30.

The lateral movement of the diaphragm 12 is restricted by the support portion 41 of the member 40, which may serve as a suitable enabling space between the diaphragm 12 and the member 40. Such support portion 41 may be constructed of a ring or a number of bumps. If the support portion 41 is constructed of a ring, a tense sound-sealed space would be formed when the diaphragm 12 rests against the support portion 41, and as a result, the acoustic transducer would have a well-controlled low frequency roll-off. A dielectric layer 31 is provided between the diaphragm 12 and the base 30. A conducting electrode 42 is fixed beneath the nonconductive member 40. The member 40 has several holes 21, and the diaphragm 12 also has several holes for creating a passageway 14 for sound flow with the holes 21 in the member 40.

The microphone structure design by Knowles Corp. is mainly a finger structure design directed to a back plate for increasing the strength of the back plate so as to reduce the resistance of the back plate. The diaphragm utilizes a design approach of decreasing the residual stress, and employs a common circular diaphragm design. The diaphragm provides only a simple support, and although its structure can avoid the problem of residual stress and a high natural frequency response, the effective deformation amount and the compliance of its design are still inadequate.

Referring to FIG. 4, another microphone structure design by Knowles Corp. is shown. This structure is essentially the same as that of FIGS. 1 to 3, with the only difference that the diaphragm 12 is connected to the base 30 via several spring structures 11 in order to decrease the intrinsic stress of the diaphragm and the stress generated from the base 30 or the packaged device.

Traditional microphone element designs utilize a simple and fixed diaphragm design. Although there are design approaches for increasing the diaphragm compliance, such as the finger structure shown in FIG. 5 in which a diaphragm 510 has a finger structure, or the corrugated structure shown in FIG. 6 in which a diaphragm 610 has a corrugated structure, most designs have disadvantages. Though the diaphragm of finger diaphragm design is soft and sensitive, it has a low resonant frequency response and is prone to fracture. Though the diaphragm of corrugated diaphragm design can effectively reduce the influence of the residual stress to enable large diaphragm compliance, it has a complicated process and is difficult to be processed, and the increase in the compliance is limited.

SUMMARY OF THE INVENTION

Accordingly, the present invention is directed to provide a structure for increasing the diaphragm compliance and creating a low spring constant through a new structure design, to enable an acoustic transducer to further have the performance of high compliance and deformation amount.

An acoustic transducer provided by the present invention includes a capacitive sound pressure sensing element, which includes two or more parallel plates with conductive material thereon to constitute a capacitor, with acoustic holes formed on at least one of the parallel plates, and a spring structure provided on at least one of the other parallel plates.

The structural composition of a miniature acoustic transducer provided by the present invention includes a substrate and a back plate and diaphragm formed thereon. The back plate has multiple acoustic holes, and a surface of the diaphragm has one or more indentations. The indentations contact the back plate to form a support structure. The other surface of the diaphragm has a cut bridge structure. When a sound pressure is transmitted to the diaphragm, the bridge structure would deform because of the support of the indentations. The deformation amount of displacement of the diaphragm is thus increased, whereby the electric field distribution of the capacitor is between the diaphragm and the back plate. When a sound pressure causes the diaphragm to deform and the bridge structure to displace, the resulting variation magnitude in the capacitance serves as the principle of the sensing.

In order to make the aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
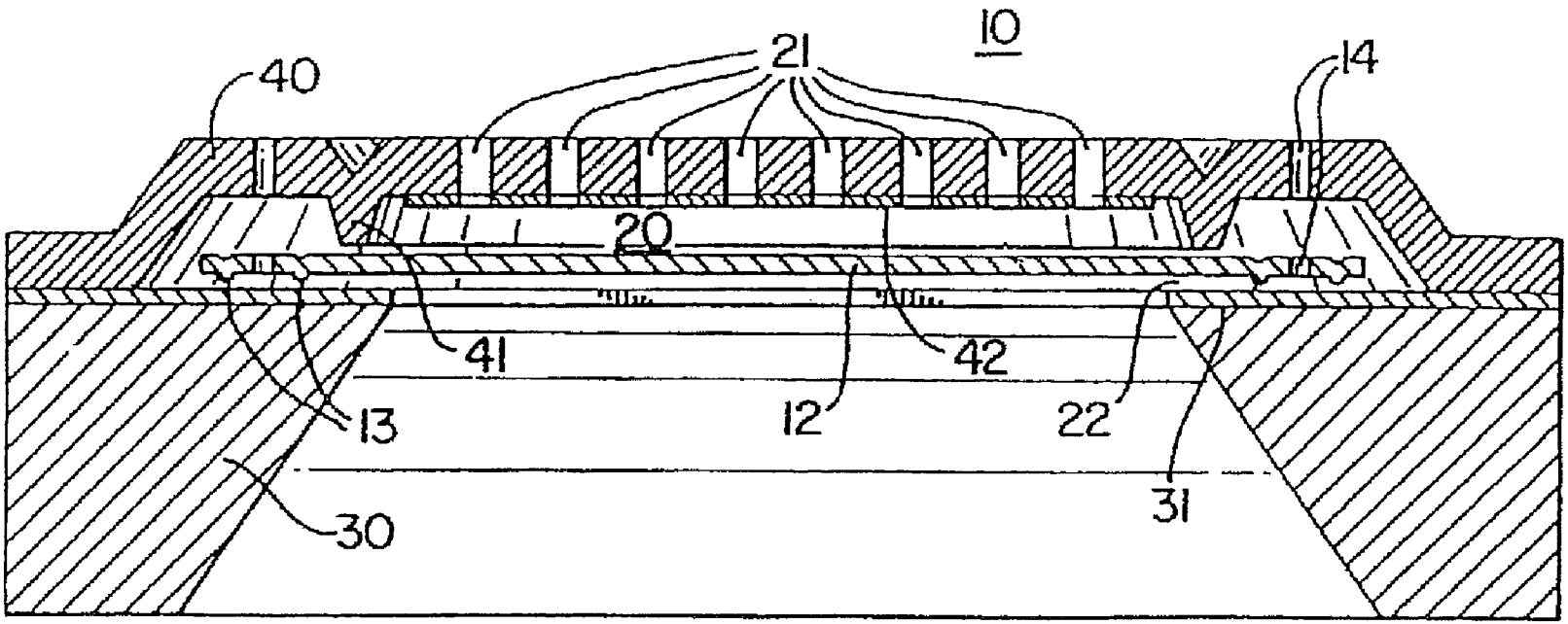
FIGS. 1 to 3 are the structure designs of a conventional microphone.
Figure 2:
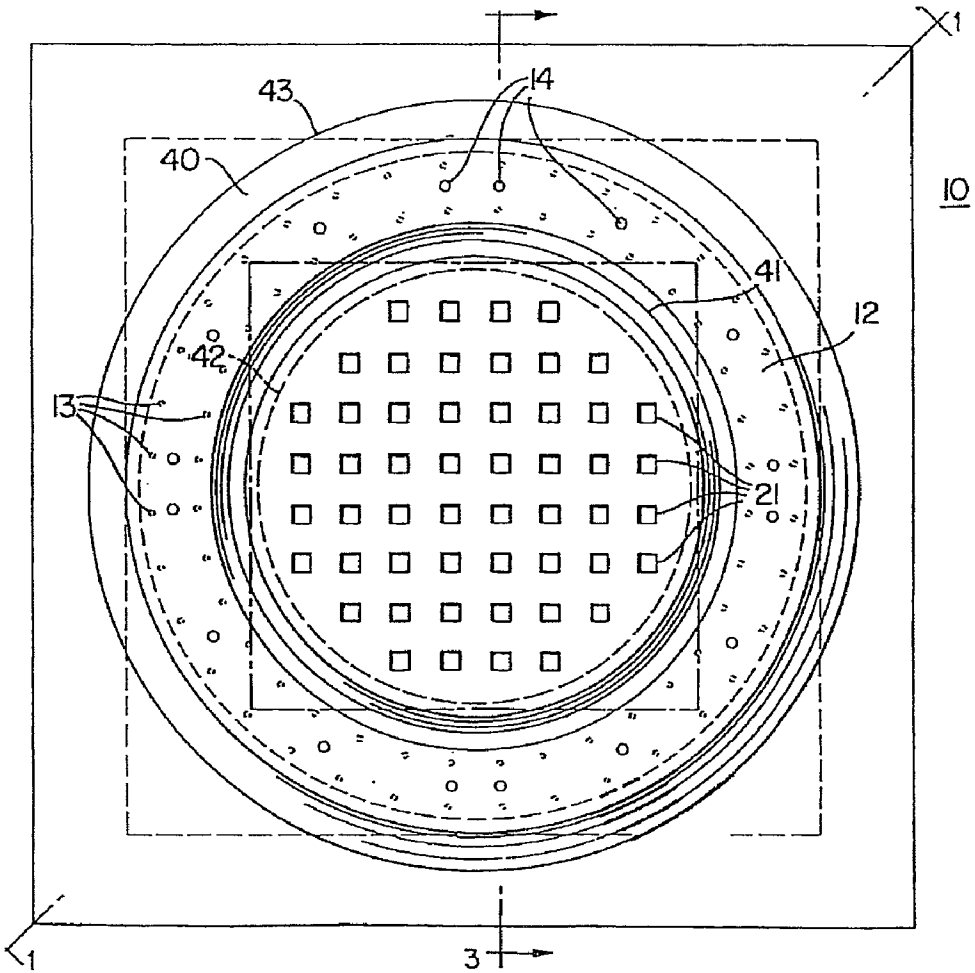
FIG. 2 (PRIOR ART)
Figure 3:
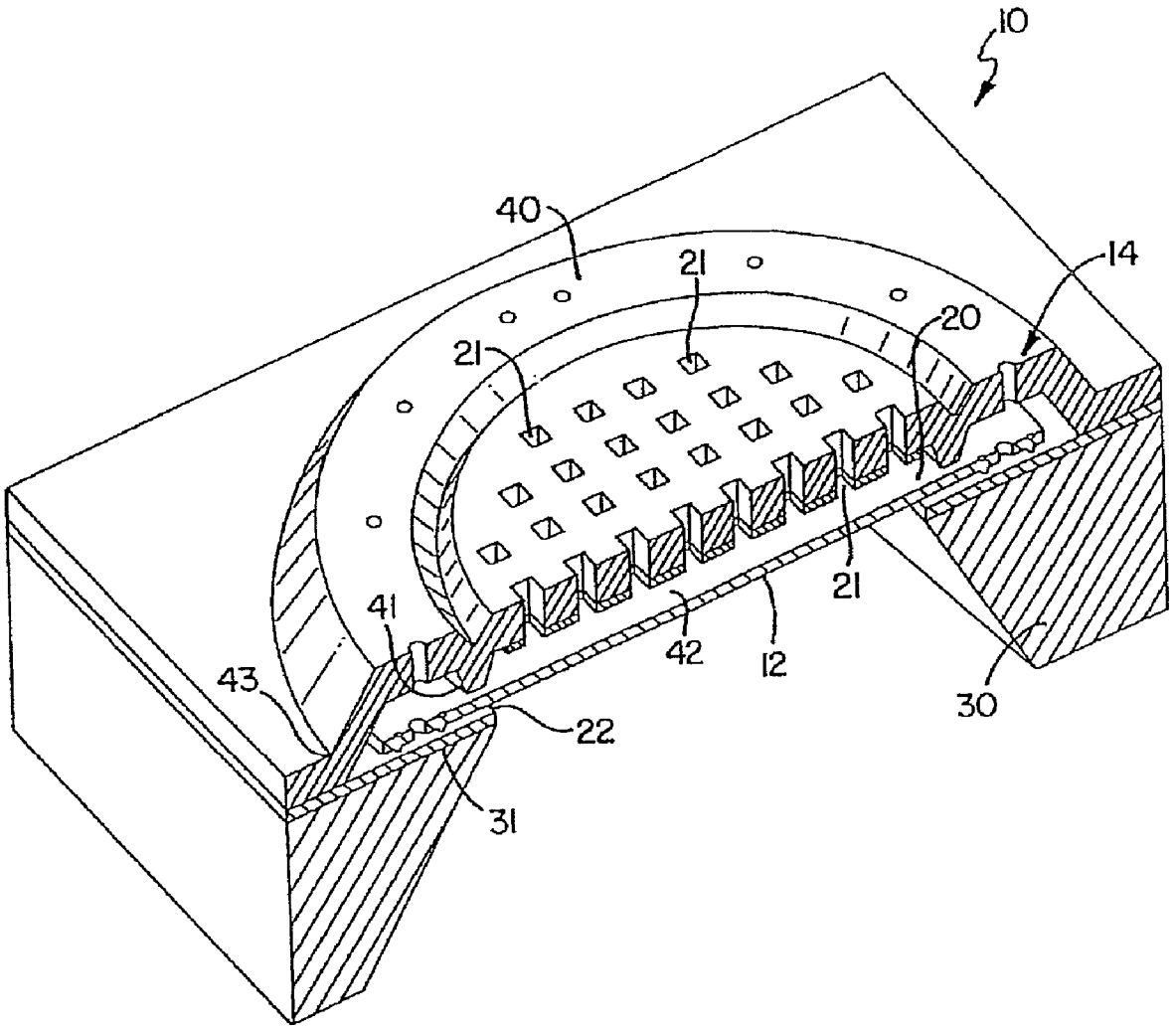
FIG . 3 (PRIOR ART)
Figure 4:
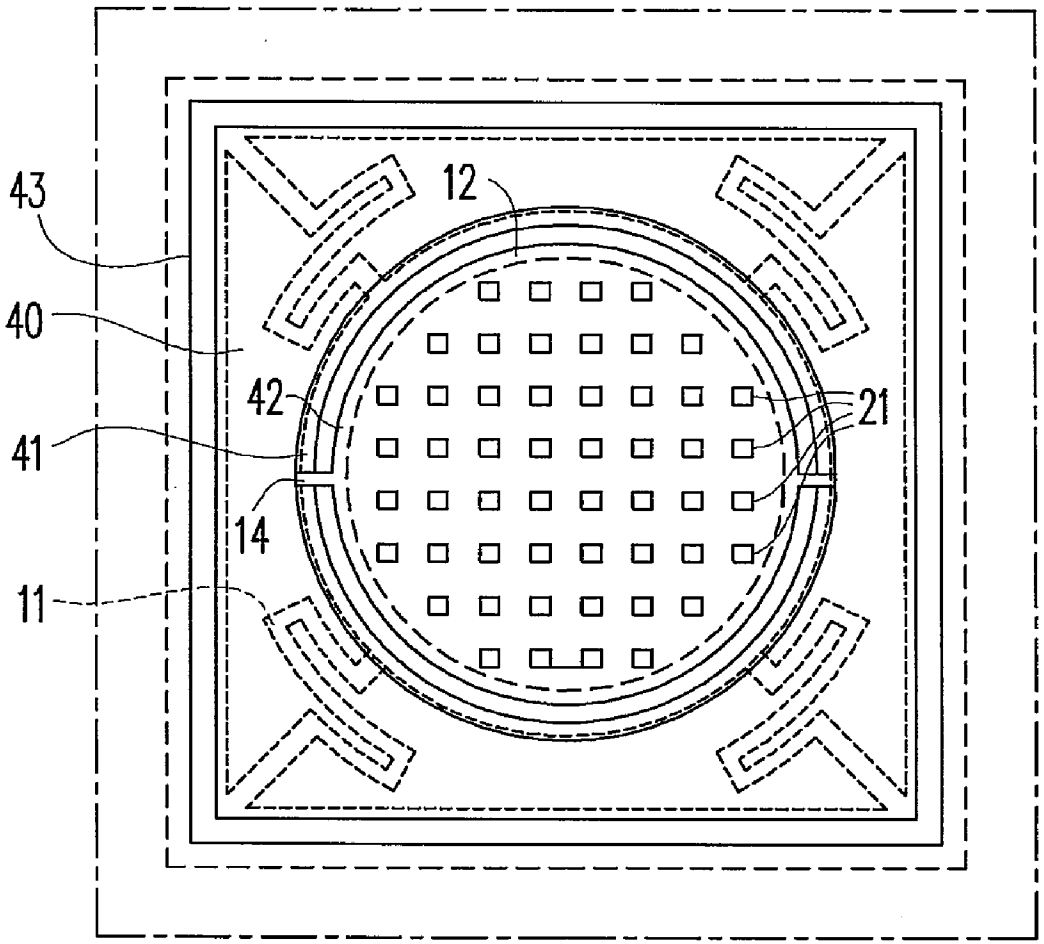
FIG. 4 (PRIOR ART)
FIG. 4 is the structure design of another conventional microphone.
Figure 5:
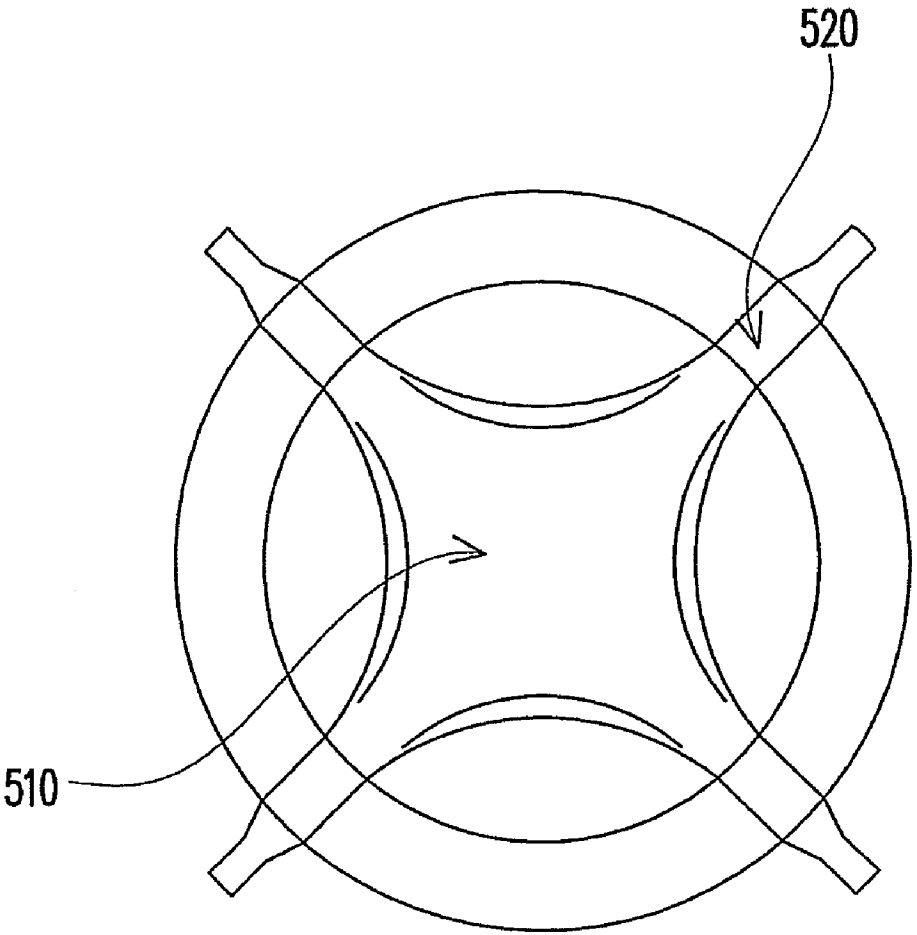
FIG. 5 (PRIOR ART)
FIG. 5 is a diaphragm design with finger structure in a conventional microphone design.
Figure 6:
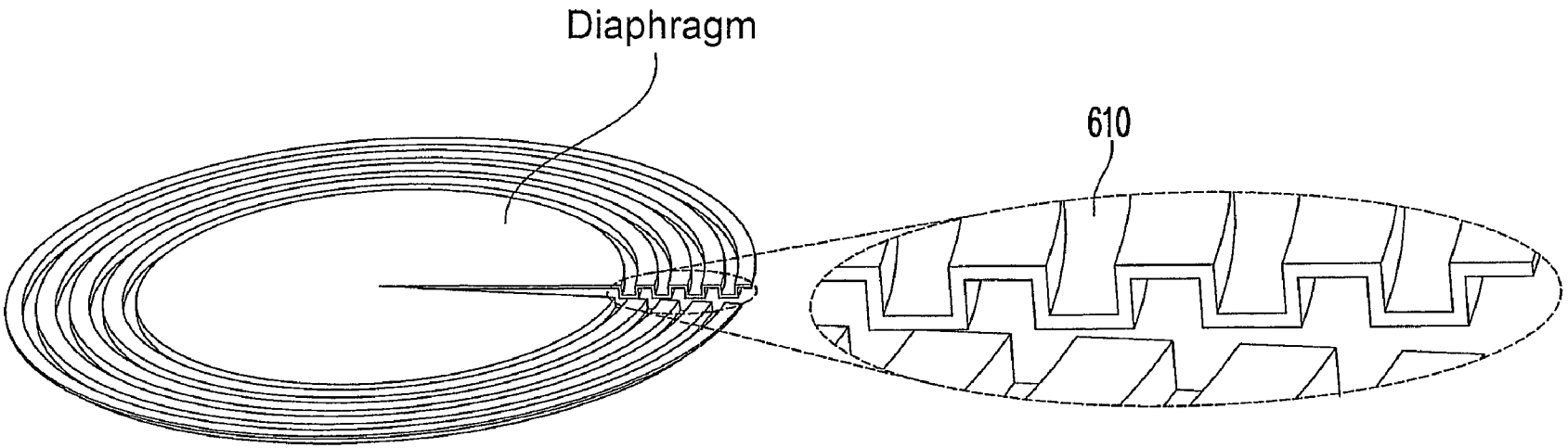
FIG. 6 (PRIOR ART)
FIG. 6 is a diaphragm design with corrugated structure in a conventional microphone design.

The present invention provides an acoustic transducer, in which a bridge-like spring structure is constructed by fabricating a special structural pattern on a pressure sensing diaphragm in combination with indentations on the diaphragm as supports, utilizing the conception of a spring structure, so that the performance of the acoustic transducer is improved. The present acoustic transducer follows a principle that in order to effectively increase the compliance with a simple structure, the design pattern for the diaphragm may be changed and a structural effect similar to that of a spring may be produced via a support structure to increase the diaphragm compliance. The present invention provides a structure of a miniature acoustic transducer, which is useful in, for example, a miniature microphone element or any electronic device requiring sounds to be converted into signals, such as a handset or a miniature microphone, or any electronic device that detects variations in the air pressure and converts the variations into signals.

The structural composition of a miniature acoustic transducer provided by the present invention includes a capacitive sound pressure-sensing element. This capacitive sound pressure-sensing element includes two or more parallel plates with conductive materials thereon to compose a capacitor, wherein acoustic holes are formed on at least one of the parallel plates and a spring structure is constructed on at least one of the other parallel plates.

A miniature acoustic transducer provided by the present invention may be applied to devices such as pressure sensors, acceleration sensors or ultrasonic sensors.

In one embodiment, the structural composition of a miniature acoustic transducer provided by the present invention includes a substrate and a back plate and diaphragm on the substrate. The back plate has multiple acoustic holes, and the surface of the diaphragm has one or more indentations. The indentations contact the back plate to form a support structure. The surface of the diaphragm described above has a cut bridge structure. When a sound pressure is transmitted to the diaphragm, the bridge structure would deform because of the support from the indentations. Thus the deformation amount of displacement of the diaphragm is thus increased, whereby the electric field distribution of the capacitor is between the diaphragm and the back plate. When a sound pressure causes the diaphragm to deform and the bridge structure to displace, the resulting variation magnitude in the capacitance serves as the principle of the sensing.

The diaphragm is a deformable diaphragm sensor unit, for example, of a pattern design having one or more special bridges or beams. Additionally, the surface of the diaphragm has a single or more indentations for supporting the diaphragm. The indentations under each bridge or beam structure create a set of spring-like effect, so that multiple sets of structures with spring-like effect, referred to as bridge spring or beam spring, exist on the diaphragm.

When the air pressure is transferred to the diaphragm, the diaphragm would deform. The indentations on the lower surface of the diaphragm create a contact support with the back plate. The bridges or beams on the diaphragm deform considerably because of the supporting force from the indentations. At this time, the diaphragm plate deforms accordingly with up and down displacement, which increases the deformation and displacement amount between the two plates and thus indirectly increases the value of the capacitance variation between the plates. Such a design significantly increases the diaphragm compliance. The capacitance variation between the diaphragm and the back plate in the microphone will be sent out as measured signals via the conductive design.

The aforementioned deformable diaphragm sensor unit and the back plate structure may be comprised of one or more materials, including carbon-based polymers, silicon, silicon nitride, polycrystalline silicon, amorphous silicon, silicon dioxide, silicon carbide, germanium, gallium, arsenide, carbon, titanium, gold, iron, copper, chromium, tungsten, aluminum, platinum, nickel, tantalum, or the alloys thereof etc.

Figure 7A:
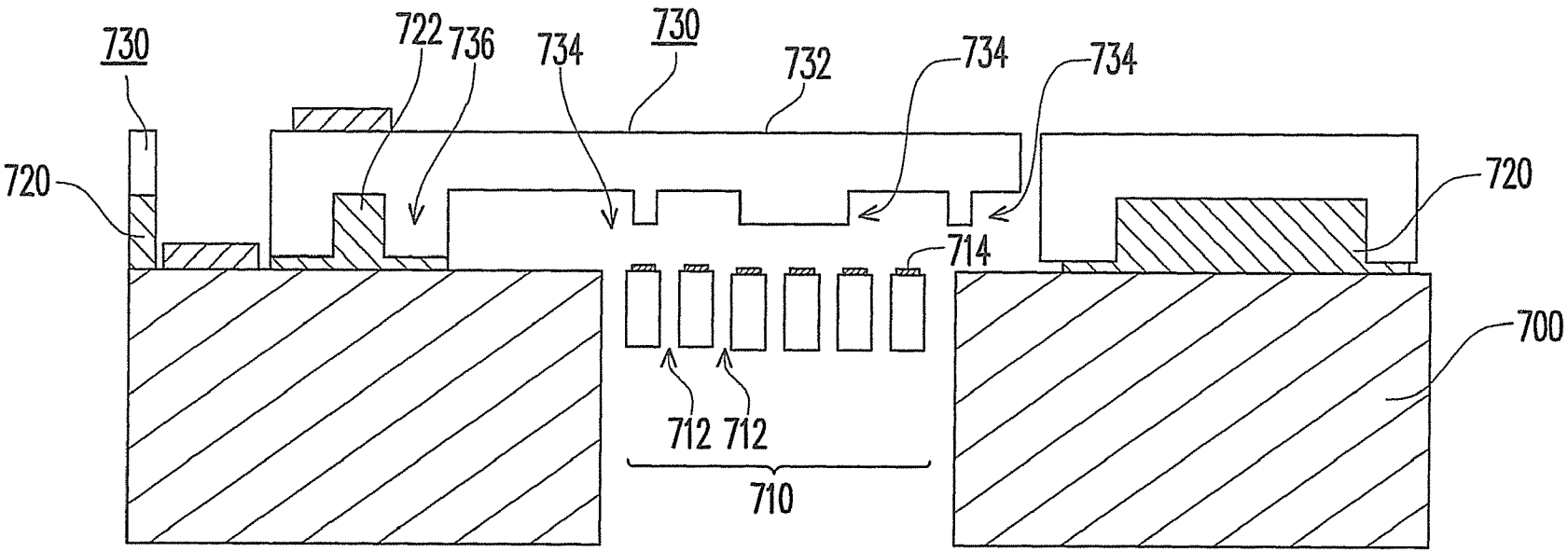
FIGS. 7A and 7B are cross-sectional schematics illustrating an acoustic transducer with a bridge spring according to a preferred embodiment of the present invention.
Figure 7B:
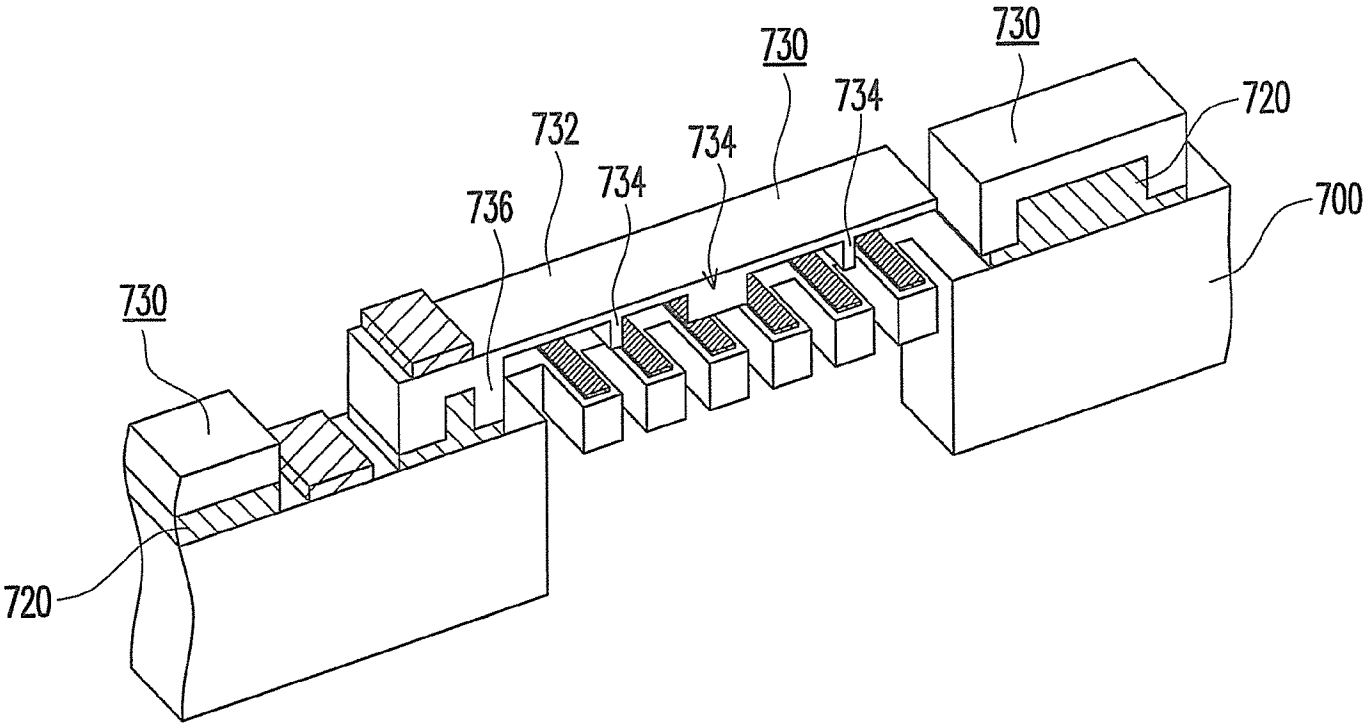
Figure 8:
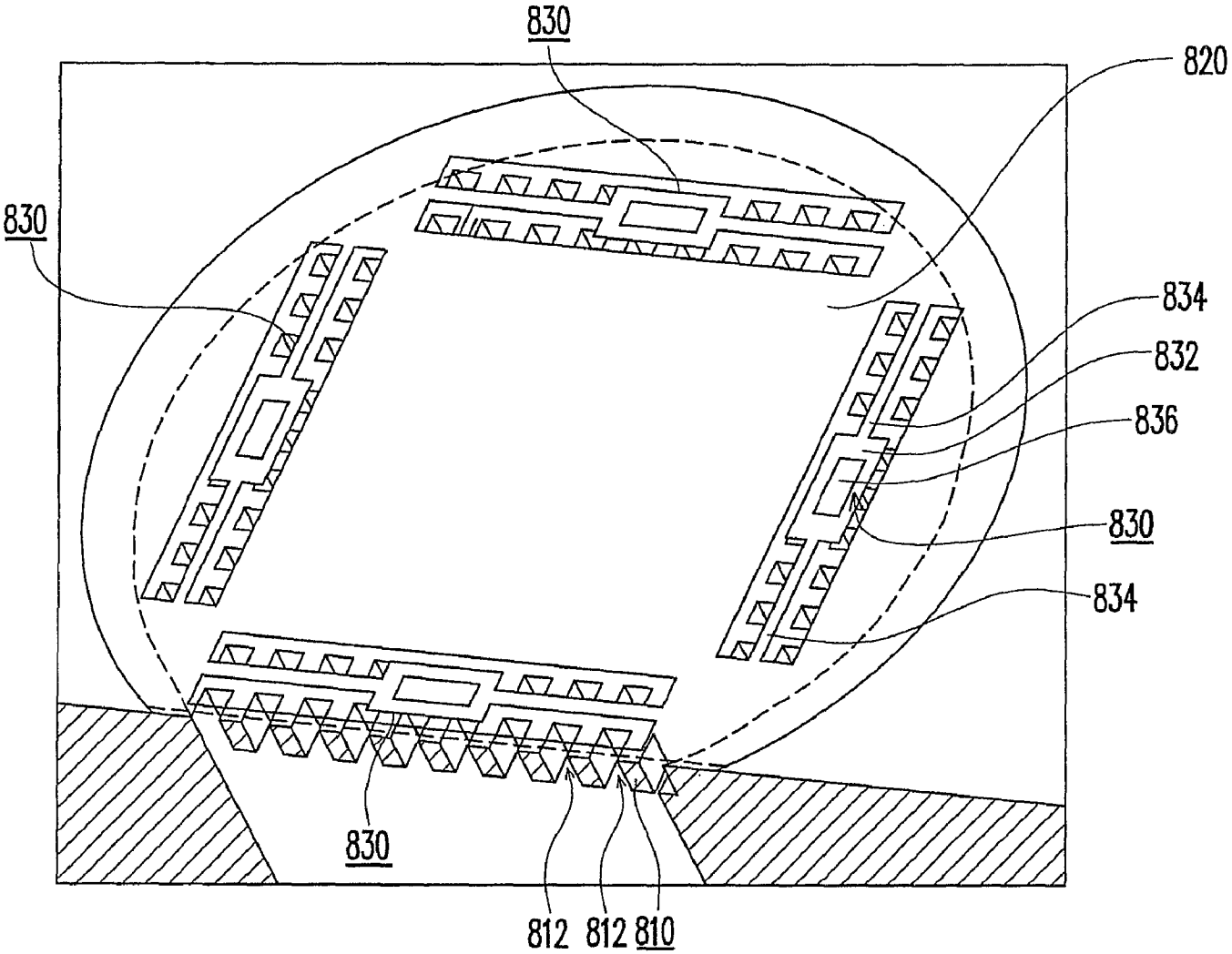
FIGS. 8 and 9 are perspective and cross-sectional views illustrating an acoustic transducer with a bridge spring according to a preferred embodiment of the present invention.

The present invention provides an acoustic transducer with a bridge spring or beam spring structure, and the construction of the acoustic transducer in one embodiment is shown in FIGS. 7A and 7B. Refer also to FIG. 8, which illustrates a perspective testing schematic of the acoustic transducer with a bridge spring structure provided by the present invention, which is described altogether hereafter. A structure of two parallel plates is formed on a substrate 700. One is a back plate structure 710 and the other is a sensing diaphragm 730, as 820 in FIG. 8. The back plate structure 710, as 810 in FIG. 8 is separated from the diaphragm 730, as 820 in FIG. 8, by an insulating layer 720, such as a layer of silicon oxide. The back plate structure 710 has multiple acoustic holes 712, as 812 in FIG. 8. The diaphragm 730, as 820 in FIG. 8, is a deformable diaphragm sensor unit, such as of a pattern design having a special bridge or beam structure.

A single or a plurality of bridge or beams is formed on the surface of the diaphragm 730, as 820 in FIG. 8. For example, as shown in FIG. 7A, a position 722 in the insulating layer 720 is combined with the base 736 of the diaphragm 730, as 820 in FIG. 8. The base 736 extends outward to form a diaphragm beam structure 732, and a structure of a single or a plurality of indentations 734 is formed on a side of the diaphragm beam structure 732 opposite to the back plate structure 710, for supporting the diaphragm beam structure 732. Of course, as described above, a part of the diaphragm beam structure 732, as the structure designated by 830 in FIG. 8, may be a bridge or a beam structure, which is described below with a bridge structure 830. The bridge structure 830 creates a set of spring-like effect with its indentations 734.

In the acoustic transducer provided by the present invention, one or more sets of structures with spring-like effect, referred to herein as bridge or beam springs, are disposed on the diaphragm 730. When the air pressure is transferred to the diaphragm 730, the diaphragm 730 would deform. The indentations 734 on the lower surface of the beam structure 732 create a contact support with the back plate 710. The bridge structure 830 on the diaphragm 730 deforms considerably because of the supporting force from the indentations 734. At this time, the diaphragm 730 deforms accordingly with up and down displacement, which increases the deformation and displacement amount between the two plates, i.e. the back plate structure 710 and the diaphragm 730, and thus indirectly increases the value of the capacitance variation between the two plates. With the conductive material disposed on the diaphragm 730 and the whole layer of a conductive layer 714 applied on the substrate 700, the capacitance variations are sensed and measured. In the aforementioned conductive design, the two plates, i.e. the back plate structure 710 and the diaphragm 730 may alternatively be comprised of conductive materials and constitute two parallel electrodes of a capacitor. The above design would significantly increase the diaphragm compliance. The capacitance variation between the diaphragm and the back plate in the microphone will be sent out via such a conductive design.

Figure 9:
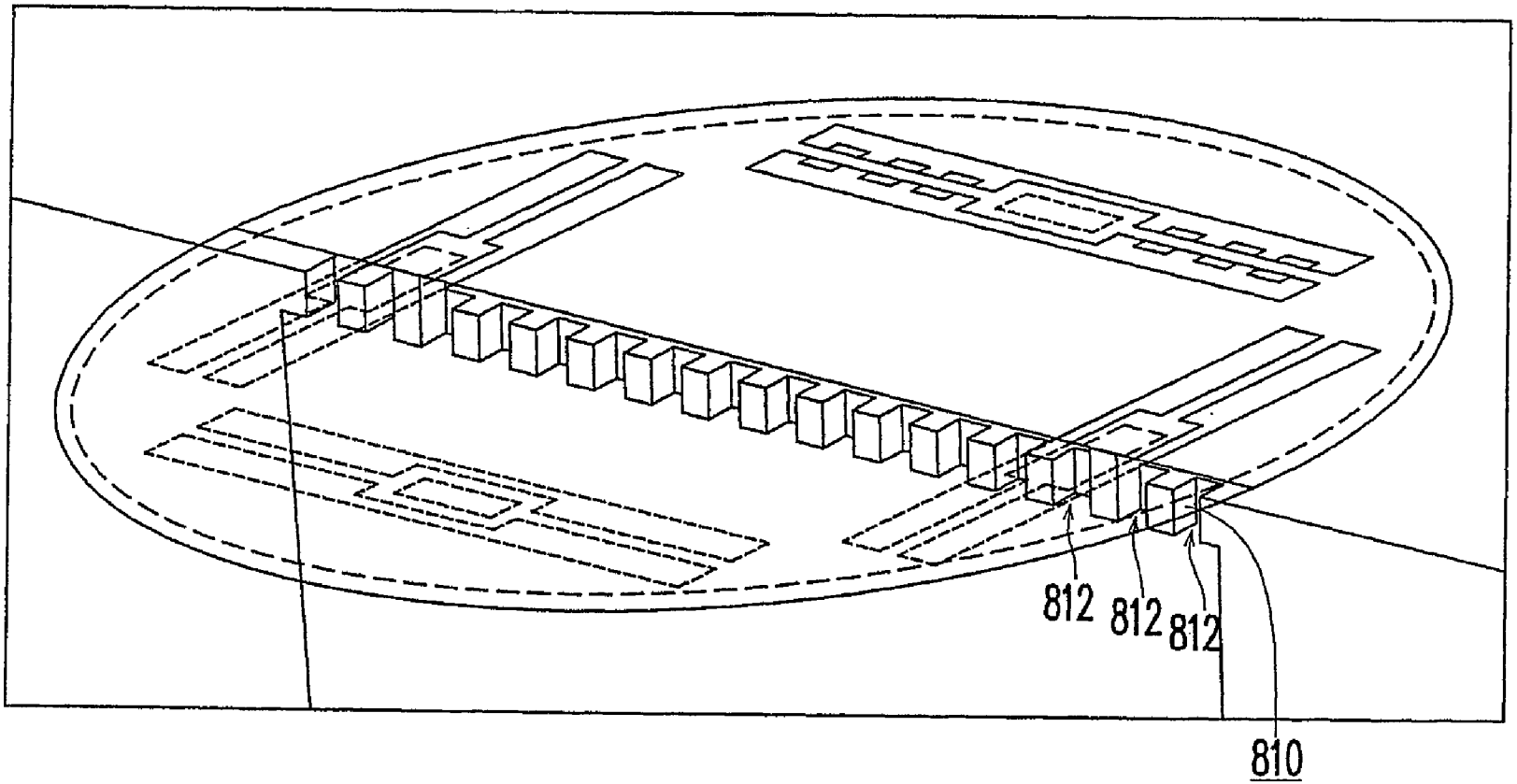

Referring to FIG. 8, a structure of two parallel plates, including a back plate structure 810 and a diaphragm 820, is formed on a substrate. The back plate structure 810 has multiple acoustic holes 812. The surface of the diaphragm 820 has four bridge spring structures 830, though the amount may be adjusted depending on design requirements. The bridge structure 830 includes two beams 832 and 834, and a central portion 836 of the bridge with indentations 734 below. The indentations 734 are formed on a side of the bridge structure 830 opposite to the back plate structure 810. The indentations 734 on the lower surface of the bridge spring structure 830 create a contact support with the back plate structure 810, to make the bridge structure 830 create a set of spring-like effect with its indentations 734. That is to say, the bridge structures 830 on the diaphragm 820 deform considerably because of the supporting force from the indentations 734. At this time, the diaphragm 820 deforms accordingly with up and down displacement, which increases the deformation and displacement amount between the two plates, i.e. the back plate structure 810 and the diaphragm 820, and thus indirectly increases the value of the capacitance variation between the two plates. FIG. 9 illustrates a bridge structure of the acoustic transducer of FIG. 8 in which the back plate structure 810 has the structure of multiple acoustic holes 812.

The present disclosure provides a structure for increasing diaphragm compliance and creating a low spring constant through a new structure design, enabling an acoustic transducer, such as a microphone element, to further have the performance of high compliance and deformation amount.

Although the present invention has been disclosed as above with preferred embodiments, the present invention is no limited thereto. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A miniature acoustic transducer, comprising a capacitive sound pressure-sensing element, wherein the capacitive sound pressure-sensing element comprises a back plate and a diaphragm formed in parallel to each other, wherein the back plate has multiple acoustic holes, and one surface of the diaphragm opposite to the back plate has one or more indentations, and the other surface of the diaphragm has a bridge structure to increase the deformation amount of the displacement of the diaphragm.

2. The miniature acoustic transducer as claimed in claim 1, wherein the bridge structure is a beam structure.

3. A miniature acoustic transducer, comprising:

a substrate with a back plate and a diaphragm formed thereon, wherein the back plate has multiple acoustic holes, and one surface of the diaphragm opposite to the back plate has one or more indentations, and when a sound pressure is transmitted to the diaphragm, the indentations contact the back plate to create a support structure, while the other surface of the diaphragm has a cut bridge structure, which deforms because of the support of the indentations, to increase the deformation amount of the displacement of the diaphragm, so that the electric field distribution of the capacitor is between the diaphragm and the back plate and varies.

4. The miniature acoustic transducer as claimed in claim 3, wherein the support structure is comprised of an elastic structure with an elastic feature.

5. The miniature acoustic transducer as claimed in claim 3, wherein the bridge structure is a beam structure.

6. The miniature acoustic transducer as claimed in claim 3, wherein the bridge structure is a finger bridge structure.

7. The miniature acoustic transducer as claimed in claim 3, wherein the space between the back plate and the diaphragm is the distance of the deformation thereof caused by the bridge structure for supporting the diaphragm.

8. The miniature acoustic transducer as claimed in claim 3, wherein the back plate and the diaphragm are disposed in parallel, with the back plate being upper and the diaphragm being lower, with relation to an upward direction perpendicular to the substrate surface.

9. The miniature acoustic transducer as claimed in claim 8, wherein the back plate is formed on the substrate as a part of the substrate.

10. The miniature acoustic transducer as claimed in claim 8, wherein the diaphragm is formed on the substrate.

11. The miniature acoustic transducer as claimed in claim 3, wherein the back plate and the diaphragm are disposed in parallel, with the back plate being upper and the diaphragm being lower, with relation to an upward direction perpendicular to the substrate surface.

12. The miniature acoustic transducer as claimed in claim 11, wherein the diaphragm is formed on the substrate.

13. The miniature acoustic transducer as claimed in claim 11, wherein the back plate is formed on the substrate as a part of the substrate.

14. The miniature acoustic transducer as claimed in claim 3, wherein the diaphragm and the back plate are comprised of carbon-based polymers, silicon, silicon nitride, polycrystalline silicon, amorphous silicon, silicon dioxide, silicon carbide, germanium, gallium, arsenide, carbon, titanium, gold, iron, copper, chromium, tungsten, aluminum, platinum, nickel, tantalum or an alloy thereof.

15. The miniature acoustic transducer as claimed in claim 3, wherein the indentations for supporting the diaphragm are disposed on the back plate.

* * * * *